US005982332A

United States Patent [19]

Lewis, Jr.

[11] Patent Number: 5,982,332

[45] Date of Patent: Nov. 9, 1999

[54] BROAD BAND TRANSMIT AND RECEIVE ANTENNA

[75] Inventor: John R. Lewis, Jr., Little Mountain, S.C.

[73] Assignee: Shakespeare Company, Newberry, S.C.

[21] Appl. No.: 09/175,008

[22] Filed: Oct. 19, 1998

[51] Int. Cl.[6] ..... H01Q 1/24; H01Q 9/40

[52] U.S. Cl. ..... 343/749; 343/790; 343/745; 343/750; 343/802

[58] Field of Search ..... 343/749, 790, 343/791, 792, 802, 803, 793, 745, 750, 752

[56] References Cited

U.S. PATENT DOCUMENTS

| | | | |
|---|---|---|---|
| 2,486,597 | 11/1949 | Greene | 343/749 |
| 2,492,404 | 12/1949 | Streib et al. | 343/749 |
| 2,509,253 | 5/1950 | Schriefer | 343/749 |
| 2,727,232 | 12/1955 | Pryga | 343/729 |
| 4,620,194 | 10/1986 | Bel Moratalla | 343/747 |
| 4,890,116 | 12/1989 | Lewis, Jr. | 343/749 |
| 5,089,827 | 2/1992 | Pizon | 343/715 |
| 5,179,387 | 1/1993 | Wells | 343/895 |
| 5,440,317 | 8/1995 | Jalloul et al. | 343/791 |
| 5,604,506 | 2/1997 | Rodal | 343/791 |

OTHER PUBLICATIONS

*Shakespeare Company*, Military Communications (1996), pp. 1–12.

*Primary Examiner*—Don Wong
*Assistant Examiner*—James Clinger
*Attorney, Agent, or Firm*—Renner, Kenner, Greive Bobak, Taylor & Weber

[57] ABSTRACT

An antenna (100) operable over a predetermined broad band and connected to a transmission line (102) includes a tip radiator (106) having a series capacitance (129) and a base radiator/choke (104) operatively connected to the tip radiator for changing feed point reactance values to values that provide a desired bandwidth to minimize the antenna's voltage standing wave ratio (VSWR) over frequencies in the predetermined broad band. The antenna also includes a choke assembly (108) operatively connected to the transmission line for suppressing current below a predetermined point of the antenna to maintain the desired bandwidth and VSWR.

8 Claims, 9 Drawing Sheets

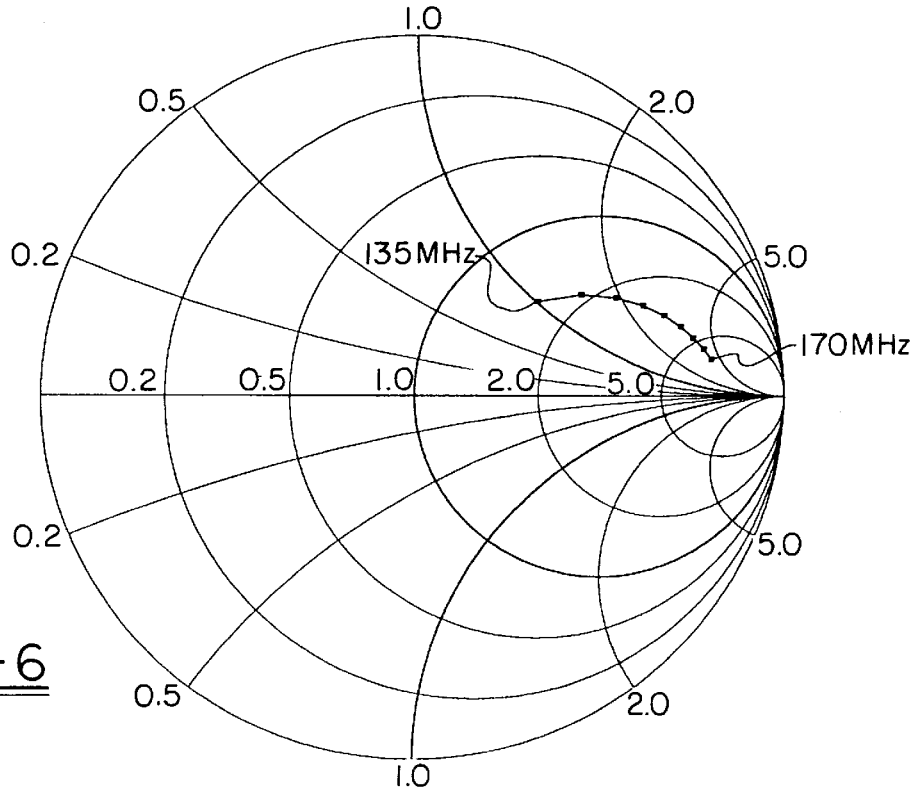
FIG.-6
FIG.-7
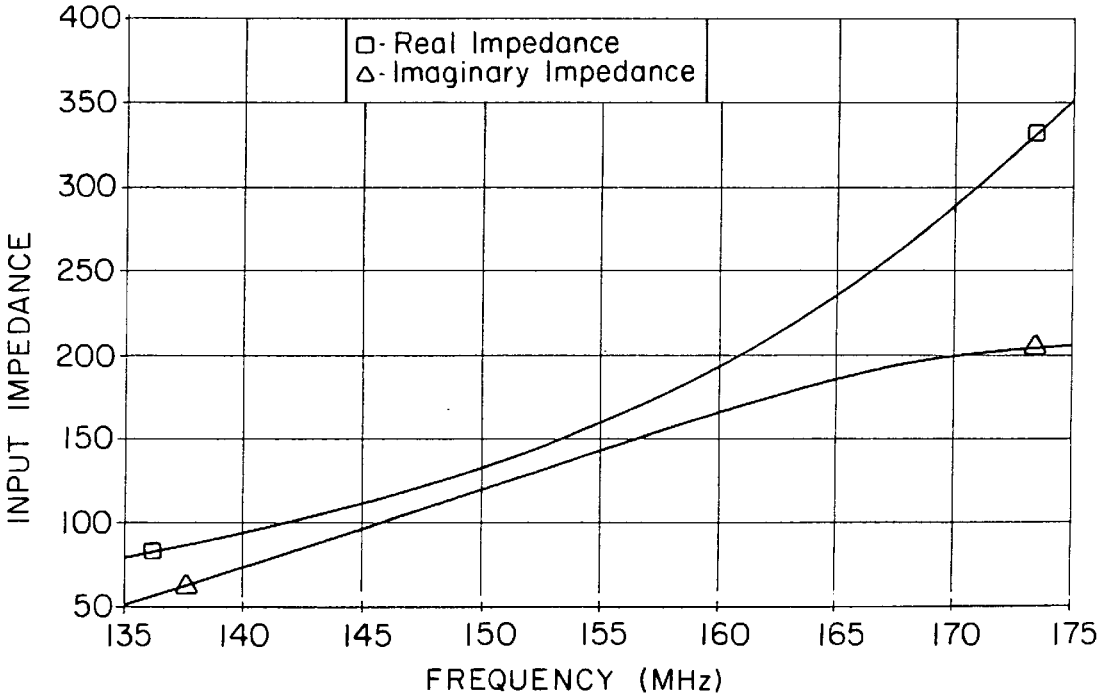

BROAD BAND TRANSMIT AND RECEIVE ANTENNA

TECHNICAL FIELD

The present invention relates generally to antennas used in mobile and/or military applications. More particularly, the present invention relates to a broad band antenna that provides an instantaneous bandwidth of about 38 MHz between the frequencies of 136 to 174 MHz while providing a 2:1 or less voltage standing wave ratio (VSWR) at the connection point of the antenna. In particular, the present invention provides an antenna wherein any frequency within the 136 to 174 MHz bandwidth provides an E-field radiation pattern which when compared to an isotropic free space radiator, has a larger radiation intensity that is broadside and perpendicular to the antenna.

BACKGROUND ART

It is known that electromagnetic communication systems employ broad bandwidth techniques, such as the so-called frequency-agile or frequency-hopping systems in which both the transmitter and receiver rapidly and frequently change communication frequencies within a broad frequency spectrum in a manner known to both units. When operating with such systems, antennas having multiple matching and/or tuning circuits that must be switched, whether manually or electronically, with the instantaneous frequency used for communications, are simply inadequate. Instead, it is imperative to have a single antenna reasonably matched and tuned to all frequencies throughout the broad frequency spectrum of interest. One attempt to provide such an antenna is disclosed in U.S. Pat. No. 4,958,164, which is incorporated herein by reference, and which is owned by the Assignee of the present invention. Although adequate in its stated purpose, the above-identified invention does not adequately perform in a higher frequency range.

Initial attempts at providing an antenna with characteristics of instantaneous bandwidth in a higher frequency and having a VSWR no greater than 2:1 were not found to be acceptable. As is known in the art, the bandwidth of an antenna is related to the "Q" of the antenna. The Q or quality factor/selectivity of an antenna can be defined as power stored in the electrical fields surrounding the antenna divided by the power radiated into space, or more simply, power stored divided by power radiated. It is well known that the lower the Q of the antenna, the larger the antenna bandwidth. The major factors affecting antenna Q are: the length/diameter ratio of the radiator; the antenna loss as related to the loss associated with conductor heat loss; placing a load such as a coil or capacitor in series at some point in the radiator; and, matching networks that may be required at the antenna base in order to match the antenna to the required 50 ohms transmission line.

A proposed quarter wave antenna was found to be unacceptable as it exhibited approximately 36 ohms radiation resistance and no reactance at the quarter wave frequency. Although no matching elements were required at the base of the radiating element, at frequencies lower than the quarter wave frequency the radiation resistance decreased and the capacitance reactance increased. At frequencies higher than the quarter wave frequency, the radiation resistance increased and reactive component acted as a series inductance with increasing reactance with increasing frequency. Based upon such an initial construction, it was found that the quarter wave antenna would be marginal at best. In particular, it was found that the VSWR requirement could only be met between the frequencies of 150 to 165 MHz. Outside of this range, the VSWR exceeded the necessary requirements.

A 5/8 wave antenna nominally exhibits approximately 50 ohms radiation resistance and a high capacity reactance at its operating frequency. In these types of construction, it is customary to insert at the base of the antenna a "matching" inductance to cancel the capacitor reactance so that the antenna system impedance is 50 ohms resistive. Although the 5/8 wave antenna is well suited to mobile installations, it was found to not meet the desired low "Q" and broad band bandwidth requirements. Such an antenna construction was found to have only an acceptable frequency range of about 148 MHz to about 158 MHz within the specified VSWR range. Accordingly, such a construction was found to be unacceptable.

One construction that was found to be promising was a capacitance loaded antenna which had a base radiator section of approximately 128.5 electrical degrees of one wavelength and a tip radiator section of approximately 64.25 electrical degrees of one wavelength. This construction includes a series insertion of a capacitance of approximately 2 pf between the base and tip radiators. This provides an antenna with the desired VSWR characteristic between 140 and 170 MHz. Unfortunately, the desired VSWR characteristics were not obtained at the extremes of the frequency bandwidth desired.

DISCLOSURE OF INVENTION

It is, therefore, an object of the present invention to provide a single, broadband transmit and receive antenna suitable for use throughout a broadband of frequencies without any need for re-matching and re-tuning.

It is another object of the present invention to provide an antenna, as above, that has an instantaneous transmit or receive bandwidth of 38 MHz between the frequencies of 136 to 174 MHz and wherein the VSWR is 2:1 or less.

It is yet another object of the present invention, as above, to provide an antenna with a radiation pattern, when compared to a free space isotropic radiator, that has a maximum radiation lobe broadside and perpendicular to the antenna radiator assembly.

These and other objects and advantages of the present invention over existing prior art forms, which will become apparent from the following description in conjunction with the accompanying drawings.

In general, an antenna operable over a predetermined broadband and connected to a transmission line includes a tip radiator, a base radiator/choke, and a choke assembly. The tip radiator includes a series capacitance and is operatively connected to a base radiator for changing feed point reactance values to values that provide a desired bandwidth to minimize the antenna's voltage standing wave ratio over frequencies in the predetermined broadband. The choke assembly is operatively connected to the base radiator for suppressing current below a predetermined point for the antenna to maintain the desired bandwidth and VSWR.

Further aspects of the present invention are provided by an antenna operable over a predetermined range of frequency and a minimal voltage standing wave ratio. Such an antenna includes a feed point tube made of conductive material receiving an insulated conductor to form an input connection. The insulated conductor extends from the feed point tube. The tip radiator is spaced apart from the feed point tube and is disposed over the remaining length of the insulated conductor. The antenna further includes a choke assembly electrically and mechanically connected to the feed point tube to minimize any currents thereon.

BRIEF DESCRIPTION OF THE DRAWINGS

For a complete understanding of the objects, techniques and structure of the invention, reference should be made to the following detailed description and accompanying drawings, wherein:

FIG. 6 is a computer simulated plot, in the form of a simplified Smith chart having 50 ohm characteristic impedance, of just a base and tip radiator of the antenna depicted in FIG. 1 over the frequency range of approximately 135 MHz to 175 MHz;

FIG. 7 is a plot of the input impedance versus frequency of the base radiator and tip radiator;

PREFERRED EMBODIMENT FOR CARRYING OUT THE INVENTION

Figure 1:
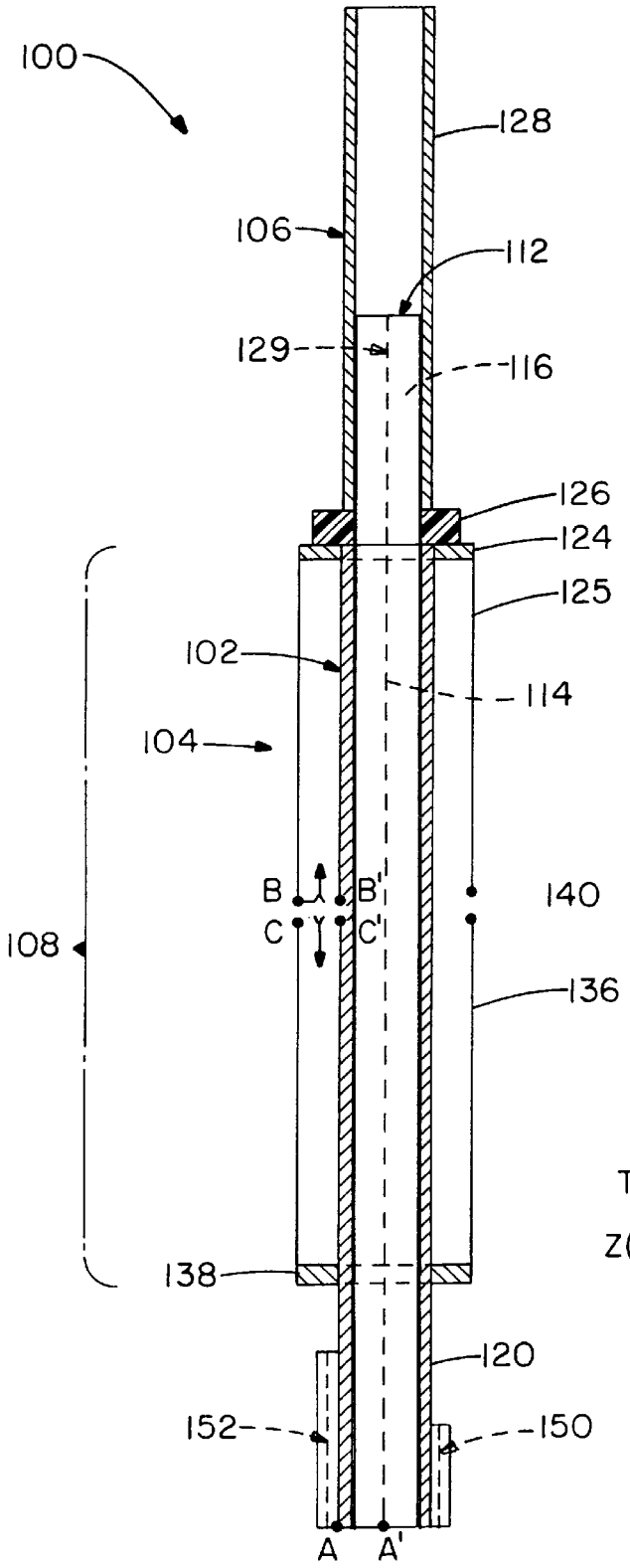
FIG. 1 is an elevational cross-sectional view of an exemplary antenna according to the concepts of the present invention.
Figure 2:
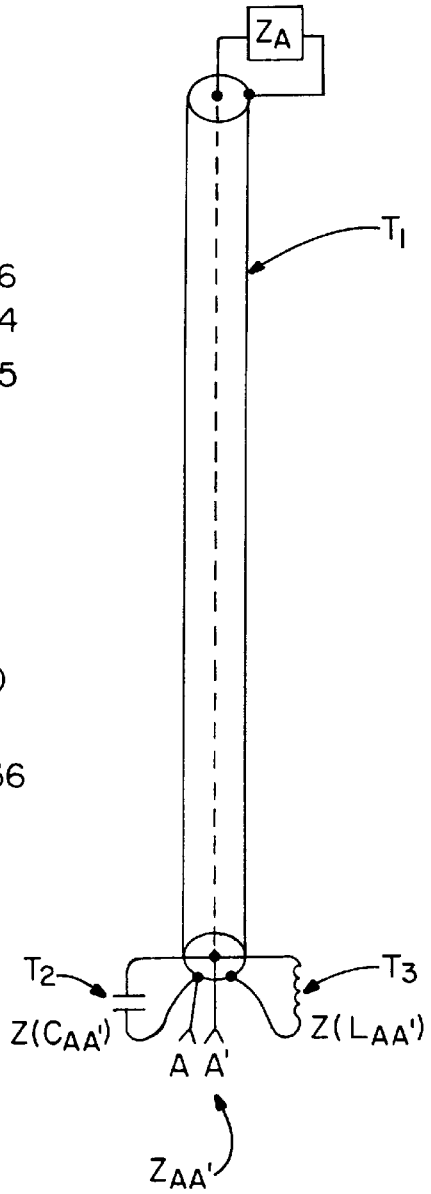
FIG. 2 is a schematic diagram of a circuit model for the exemplary antenna depicted in FIG. 1.

Referring now to the drawings and in particular to FIG. 1, a broad band antenna according to the present invention is generally indicated by the numeral 100. The antenna 100 includes a feed point transmission line 102 which is received in a base radiator/choke 104. A tip radiator 106 extends above the base radiator 104. A choke assembly 108 is incorporated with the base radiator/choke 104 as will be discussed in detail hereinbelow.

The major components of the antenna, the base radiator/choke 104, the tip radiator 106, and the choke assembly 108 are configured and received in a tapered cylindrical core made of non-conductive material such as fiber reinforced plastic and enclosed within a fiberglass or plastic cover laminate (not shown). A plastic cap may be employed to cover the top of the cylindrical core to protect the components within the core.

The feed point transmission line 102 employs a coaxial cable 112 which, in the preferred embodiment, is about 53½ inches in length. The cable 112 includes a center conductor 114 which, in the preferred embodiment, is a 22 AWG copper cladsteel wire, surrounded by an air-space dielectric material 116 which, in the preferred embodiment, is irradiated polyethylene. Of course, other similar coaxial cable constructions may be employed.

The base radiator/choke 104 includes a feed point tube 120 which, in the preferred embodiment, is abrass tube about 47 inches in length, disposed about the coaxial cable 112. Accordingly, a connection plane AA' is formed between the feed point tube 120 and the center conductor 114. The base radiator/choke 104 further includes a shorting washer 124 and a choke tube 125 directed toward the connection plane AA'. The choke tube 125 is electrically and mechanically connected to the feed point tube 120 by the shorting washer 124.

The tip radiator 106 includes a spacer 126 which, in the preferred embodiment, is made of Teflon®, wherein the spacer 126 is supported by the washer 124. A radiator tube 128 abuts the spacer 126 and receives therein the remaining length of coaxial cable 112 that extends from the feed point tube 120. The position of the radiator tube 128 about the coax cable 112 creates a feed point coaxial distributive capacitor 129. In the preferred embodiment, the radiator tube 128 is a brass tube 25½ inches in length. The electrical length of the tip radiator 106 is approximately 0.304 of one wavelength at 136 MHz and approximately 0.390 of one wavelength at 174 MHz. From the tip electrical length information, it should be noted that the feed point of the antenna 100 is fed off-center from what is normally called a center fed dipole antenna.

The base radiator/choke 104 is made from brass tubing and in the preferred embodiment, has a length of about 18½ inches. Using the same reference used to determine the electrical length of the tip radiator 106, the electrical length of the base radiator/choke 104 is approximately 0.222 of one wavelength at 136 MHz and approximately 0.285 of one wavelength at 174 MHz. Therefore, the total electrical length of the tip radiator and base radiator/choke is approximately 0.526 of one wavelength at 136 MHz and approximately 0.675 of one wavelength at 174 MHz.

The choke assembly 108, which incorporates the choke tube 125 and the washer 124, further includes an inverted choke tube 136 which, in the preferred embodiment, is the same length as the choke tube 125. A washer 138 interconnects the inverted choke tube 136 to the feed point tube 120 near the connection point AA'. The inverted choke tube 136 is spaced apart from the choke tube 125 about ⅛ inch to form a gap 140 which is designated as BB' and CC' in FIG. 1. As will be explained in further detail hereinbelow, an inductance matching stub 150 is connected across the connection point AA' as is a capacitance matching stub 152.

Referring now to FIGS. 2–5, a circuit model, according to the antenna shown and described in FIG. 1, is presented. In particular, the coaxial transmission line 102 is generally designated by the symbol $T_1$ and is provided with a characteristic impedance of approximately 132 ohms. The antenna 100 has an antenna feed point impedance generally designated by $Z_A$. Accordingly, with the conductive matching stub 150 and the capacitance matching stub 152, the impedance at point AA' (where the transmitter is connected, neglecting loss) is given by the parallel combination of $Z(T_1)$, $Z(C_{AA'})$, and $Z(L_{AA'})$. Based upon the circuit model presented in FIG. 2, the following equations are employed to determine a value for $Z_{AA'}$.

$$Z(T_1) = Z_O(T_1)Z_A + \frac{JZ_O(T_1)\mathrm{Tan}\theta_1}{Z_O(T_1) + JZ_A\mathrm{Tan}\theta_1} \quad (1)$$

$\theta_1$ is the electrical length of the transmission line $T_1$ at the particular frequency of operation. $Z_O(T_1)$ is the characteristic impedance of the transmission line $T_1$ (approximately 132 ohms), and $Z_A$ is the antenna feed point impedance.

$$Z(C_{AA'}) = -J\frac{Z_O(T_2)}{\mathrm{Tan}\theta_2} \quad (2)$$

where $\theta_2$ is the electrical length of the open circuit stub formed by transmission line $T_2$. $Z_O(T_2)$ is the characteristic impedance of the transmission line (approximately 50 ohms).

$$Z(L_{AA'}) = +JZ_O(T_3)\mathrm{Tan}\theta_3 \quad (3)$$

where $\theta_3$ is the electrical length of the shorted stub formed by transmission line $T_3$. $Z_O(T_3)$ is the characteristic impedance of the transmission line (approximately 50 ohms). The impedance at $Z_{AA'}$ is then given by neglecting loss.

$$Z_{AA'} = \frac{1}{\frac{1}{Z(T_1)} + \frac{1}{Z(C_{AA'})} + \frac{1}{Z(L_{AA'})}} \quad (4)$$

Figure 3:
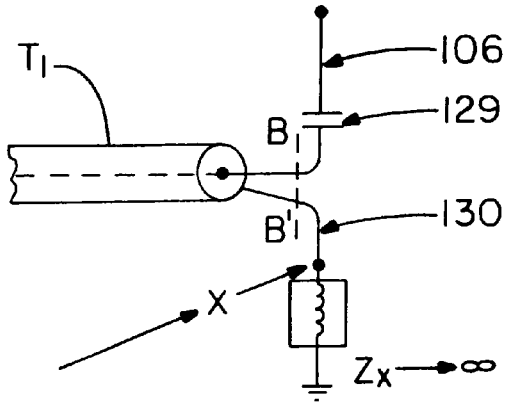
FIG. 3 is a schematic diagram of a circuit model of the impedance of the exemplary antenna at its feed point.
Figure 4:
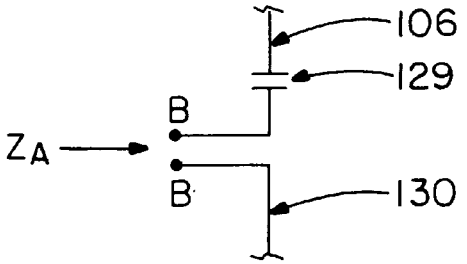
FIG. 4 is a schematic diagram of the circuit model of the exemplary antenna with its radiators disconnected.
Figure 5:
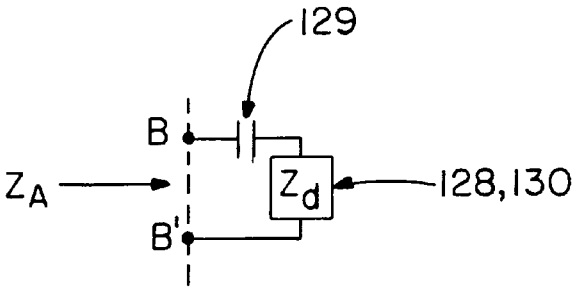
FIG. 5 is a schematic diagram of the circuit model of the impedance of the exemplary antenna.

In the foregoing equations, $Z_A$ is the impedance of the antenna at the feed point and is modeled as shown in FIG. 3. As will be appreciated, transmission line $T_1$ is connected to the transceiver at point AA'. It will also be appreciated that the choke tubes 125 and 136 cause the impedance at point X in FIG. 3 to be very large and in fact, it could be considered for the purposes of this model as being infinite. If the radiators were to be disconnected at point BB', then the radiator could be modeled as shown in FIG. 4. Thus, $Z_A$ is the impedance "looking" into terminals BB'. Accordingly, a "simple" model for $Z_A$ is provided in FIG. 5. Those skilled in the art will appreciate that $Z_d$ is the impedance due to the radiators, which are the tip radiator 106 and the base radiator/choke 104 for the surface of the choke tube 125. It should be appreciated, however, that this model is correct only when all items are in place and connected. Otherwise, the distributed capacitance cannot be made to occupy zero space. $Z_d$ is also a function of the physical placement of the distributed capacitance 129.

Having described the mechanical and electrical configuration of the antenna 100, the specific parameters of its elements as utilized in the preferred form suitable for use in the frequency range of 136 MHz to 174 MHz is provided hereinbelow.

Figure 8:
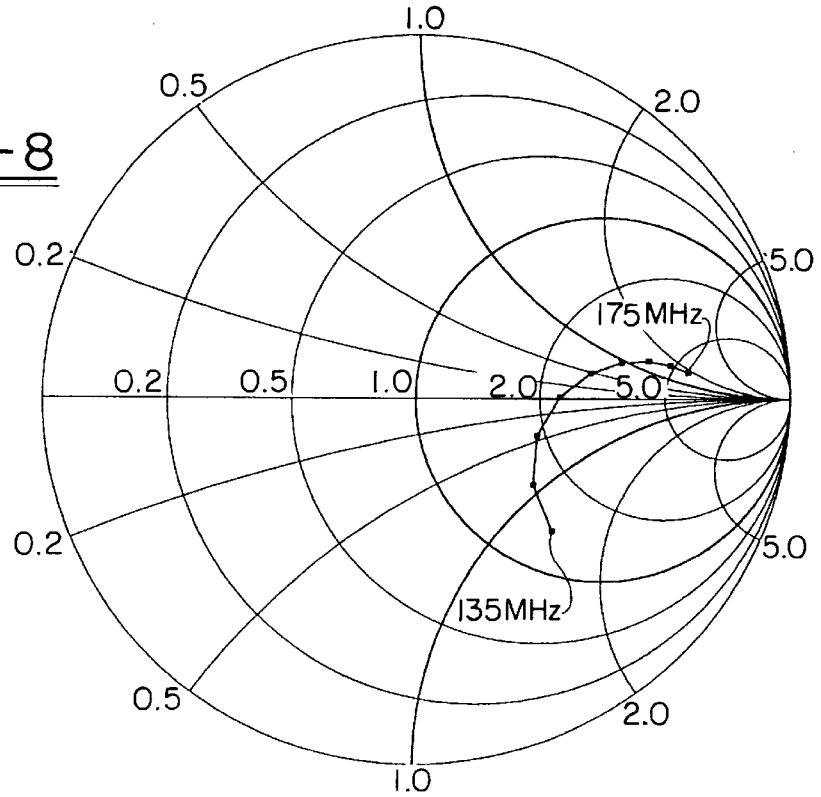
FIG. 8 is a computer simulated Smith chart plot, substantially in the same form as that of FIG. 5, depicting the impedance of the antenna modified by the addition of a capacitor inserted in series at a feed point of the antenna.
Figure 9:
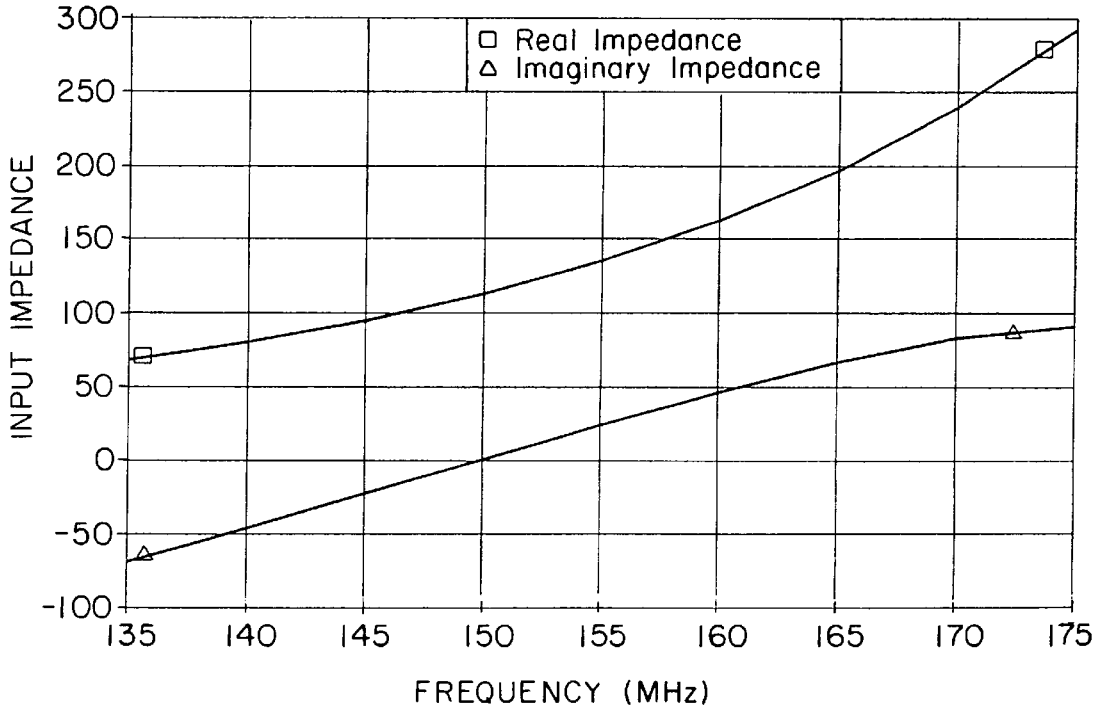
FIG. 9 is a plot of the input impedance versus frequency after insertion of the capacitance at the feed point of the antenna to illustrate that approximately one-half of the feed point reactance is (−) capacitive and one-half is (+) inductive with the feed point impedance at approximately 150 MHz on the real axis of the Smith chart.

The operation of an antenna in accordance with the concept of the present invention may be best appreciated by reference to several plots in the form of simplified Smith charts having 50 ohm characteristic impedance showing the impedance of an antenna 100 over the broad range of frequencies of interest as variations are made in certain elements therein. Based upon known information and a computer simulation using NEC-win Professional Version 1.1, FIGS. 6 and 7 illustrate the variation of feed point impedance of just the base and tip radiators of the antenna in free space at 5 MHz increments from 135 MHz to 175 MHz. The Smith chart provided by FIG. 6 (normalized to 50 ohms) shows the same information in FIG. 7 and gives a clear picture of possible matching schemes that could be used in order to power match the antenna over the broad bandwidth to a 50 ohm input transmission line. Based upon this information, a matching scheme was chosen because of the broad band requirement of the antenna and for the ease of manufacturing. To accomplish this end, a capacitance of approximately 5 pf is inserted in series at the feed point of the antenna in order to cancel a portion of the inductive reactance shown in FIG. 7. Accordingly, insertion of the distributed feed point capacitance 129 changes the feed point impedance values to those shown in FIGS. 8 and 9. Thus, it will be appreciated that the feed point impedance has changed such that approximate one-half of the feed point reactance is (–) capacitive and one-half is (+) conductive with the feed point impedance at approximately 150 MHz on the real axis of the Smith chart.

Figure 10:
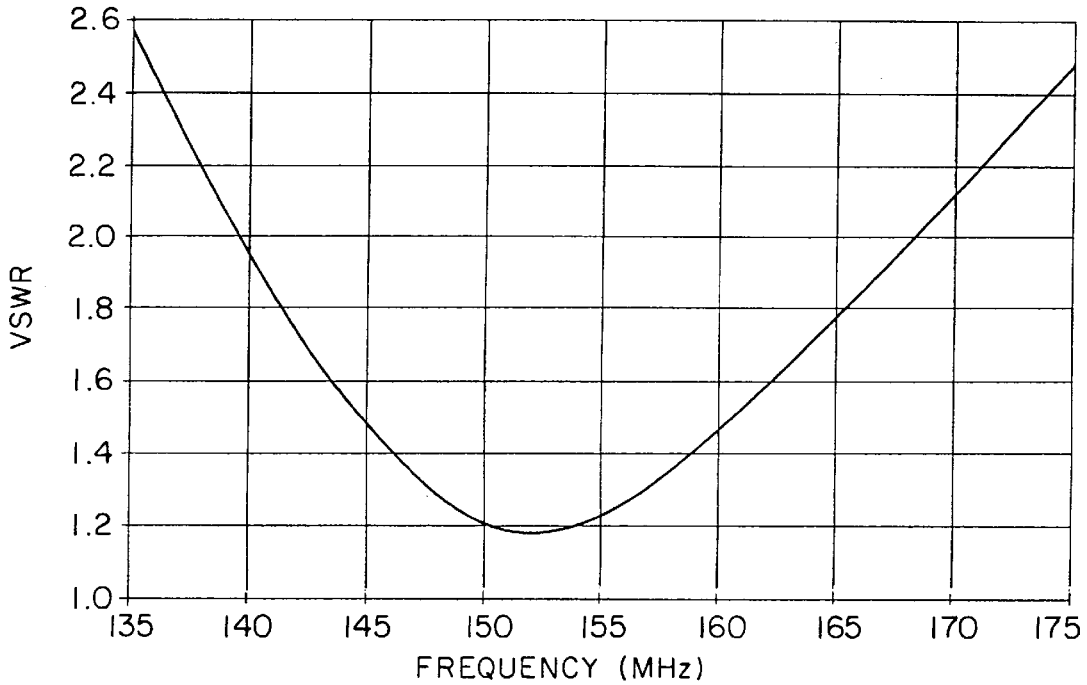
FIG. 10 is a plot of VSWR versus frequency at the feed point with reference to a 132 ohm transmission line.
Figure 11:
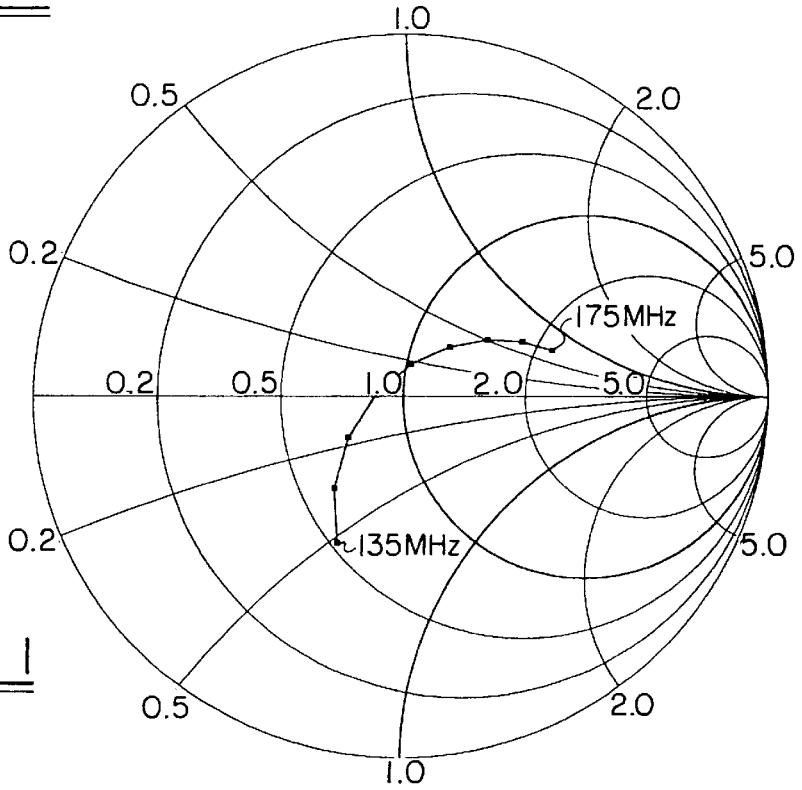
FIG. 11 is a computer simulated Smith chart plot for the information provided in FIG. 10, it is noted that both show a 2:1 VSWR bandwidth of approximately 28 MHz and a 2.5:1 VSWR bandwidth of approximately 40 MHz.

Referring now to FIGS. 10 and 11, FIG. 10 shows a plot of VSWR versus frequency at the feed point when referenced to a 132 ohm transmission feed line. The Smith chart of FIG. 11 shows the same information as in FIG. 10. It is noted that both show a 2:1 VSWR bandwidth (reference to 132 ohms) of approximately 28 MHz and a 2.5:1 VSWR bandwidth of approximately 40 MHz.

The next step in configuring the antenna 100 is to determine the length of the transmission line with a characteristic impedance of 132 ohms. Accordingly, by looking from the load impedance (antenna feed point impedance) toward the generator (transmitter), it is desired to obtain a point along the transmission line that transforms the feed point impedances (at as many of the frequencies as possible) to within a 2:1 VSWR with reference to a 50 ohm transmission line. The lengths determined for the tip radiator 106, the base radiator/choke 104, the coaxial cable 112 and the feed point tube 120 produce the desired result.

Thus, it will be appreciated that an off-center fed radiator that has a tip radiator, a base radiator, and a feed point series distributed capacitance has been shown. This construction is employed to change the feed point impedance reactance values to values such that the resulting impedance values, when transformed through a 132 ohm transmission line, position a portion of the required 38 MHz bandwidth within a 2:1 VSWR or less. Further, only a simple matching circuit at point AA' is required to match the frequencies that remain outside the 2:1 VSWR requirement to within the 2:1 requirement reference to 50 ohms.

In order that the antenna 100 function in the real world as close to the model provided and described above, currents arising on the surface of the base radiator 104 must be reduced to close to zero as possible at point BB'. In order for this to be accomplished, a back-to-back RF choke assembly 108 is required. The choke assembly 108 is employed to reduce and suppress currents that may form below points BB' and CC' as shown in FIG. 1. The two RF chokes 125 and 136 are made as electrically identical as possible so that their reactances reinforce (add with the same sign) current suppression below point BB' of the antenna. It has been determined that a gap of about ⅛ inch between the open ends of the two chokes 125 and 136 give the best overall current suppression.

It is thought that the ⅛ inch gap gives better suppression than a larger gap because that the voltage between point B and B' and the voltage between C and C' are approximately equal and approximately in phase. Therefore, the voltage between B and C should be approximately equal to 0 and there should be no current on the outside of the inverted choke 136. If the gap is made larger, it is believed that the voltages $V_{BB'}$ and $V_{CC'}$ are no longer equal and in phase and the voltage $V_{BC}$ will no longer be 0 and currents will form on the outside of the inverted choke 136.

Figure 12:
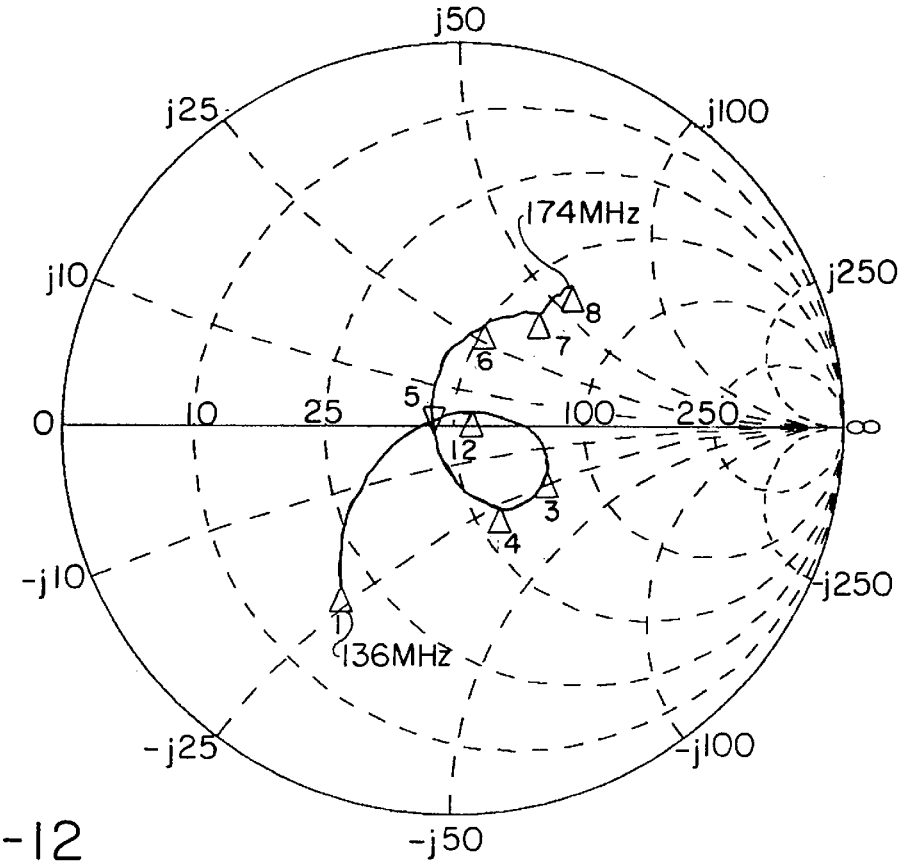
FIG. 12 is a Smith chart showing the antenna of the present invention with impedance measurements shown at plane AA' without the matching stubs connected.
Figure 13:
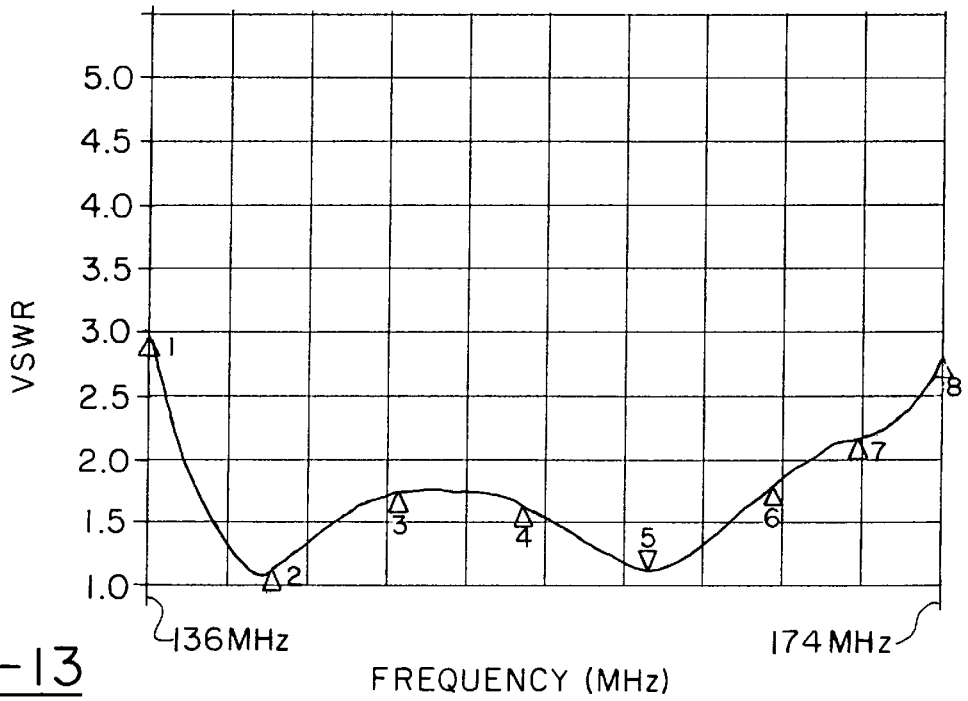
FIG. 13 is a plot of VSWR versus frequency according to the Smith chart of FIG. 12.
Figure 14:
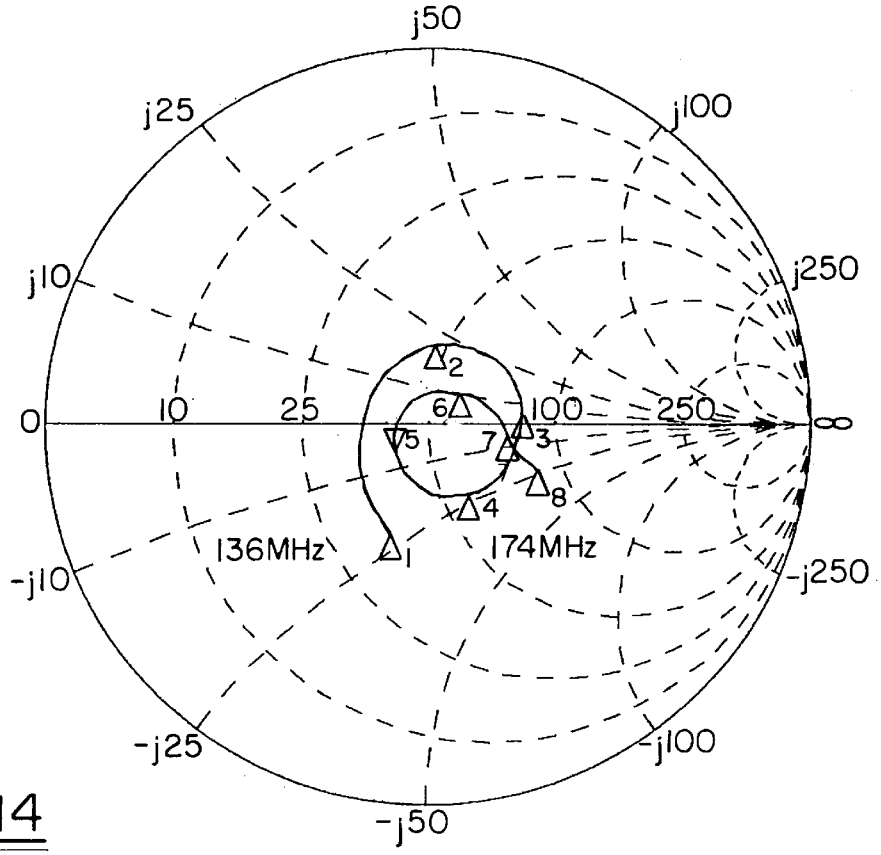
FIG. 14 is a Smith chart showing the antenna with the final matching stubs connected between points AA'.
Figure 15:
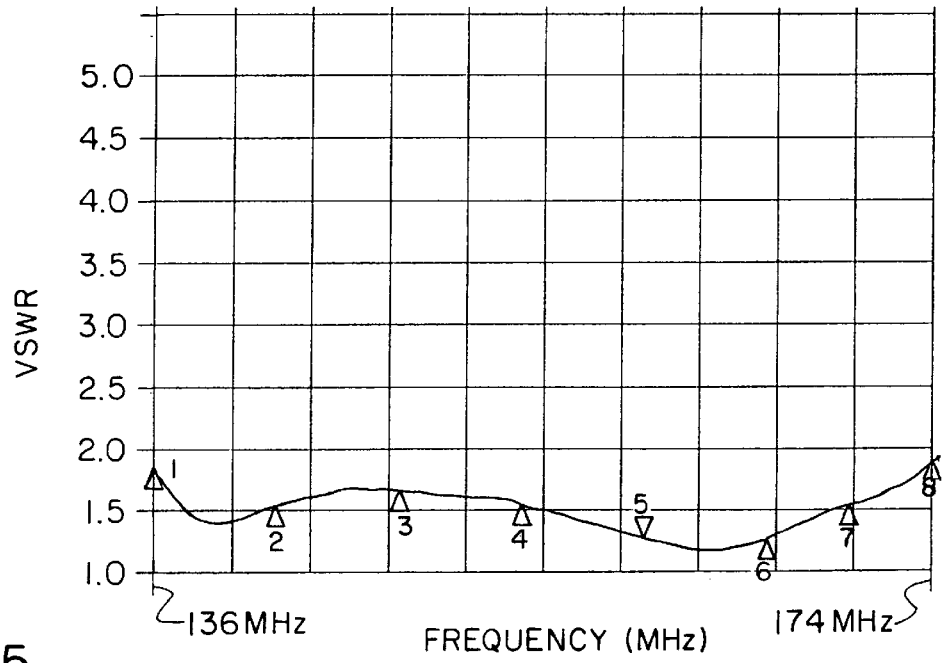
FIG. 15 is a plot of VSWR versus frequency according to the Smith chart shown in FIG. 14.

Referring now to FIGS. 12 and 13, impedance measurements at plane AA' without matching stubs are shown. By incorporating the matching stubs 150 and 152, the Smith chart and frequency plot of FIGS. 14 and 15 evidence the desired characteristics of the antenna. It should be noted that measurements were made of a prototype antenna shown in FIG. 1 and placed inside a fiberglass radome with plane AA' approximately six feet off earth with the antenna vertical with respect to the earth. All measurements made in FIGS. 12–15 were made with a Hewlett-Packard model 8714C RF network analyzer.

Figure 16:
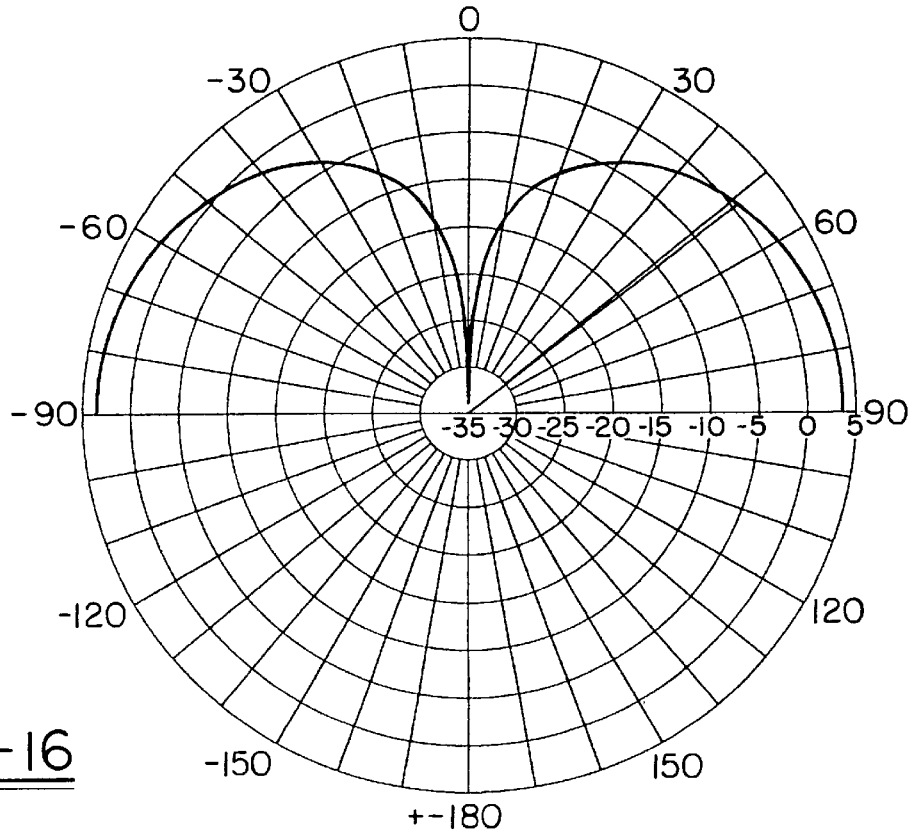
FIG. 16 is an antenna directivity pattern with the E-field broadside and perpendicular to the radiator assembly, for 136 MHz.
Figure 17:
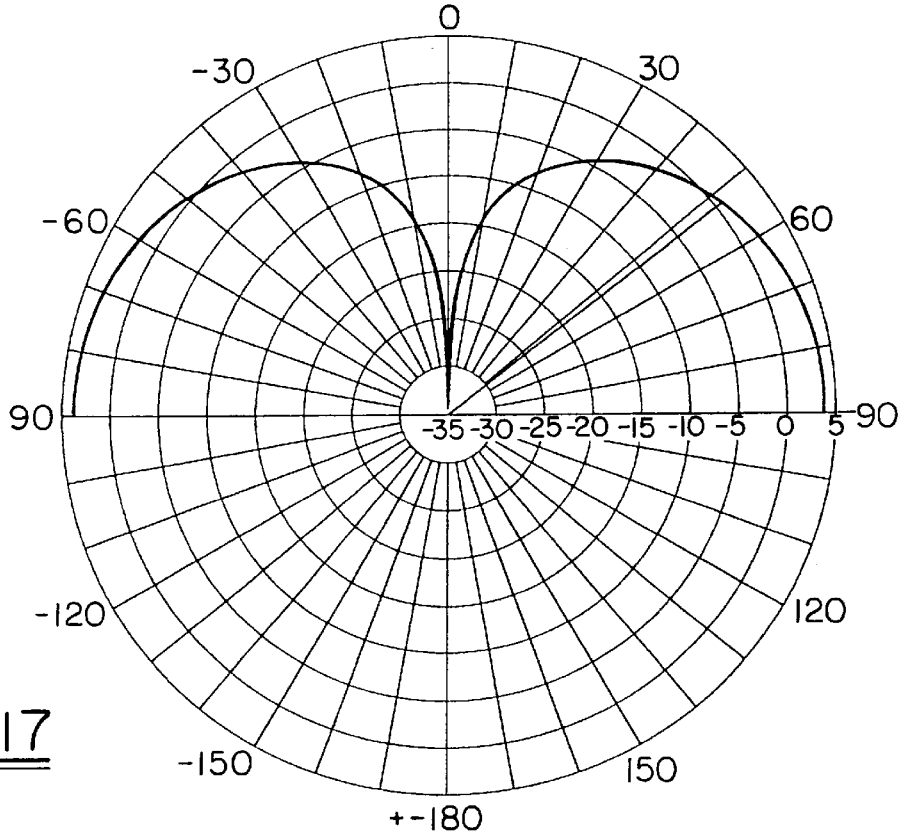
FIG. 17 is an antenna directivity pattern with the E-field broadside and perpendicular to the radiator assembly, for 155 MHz.
Figure 18:
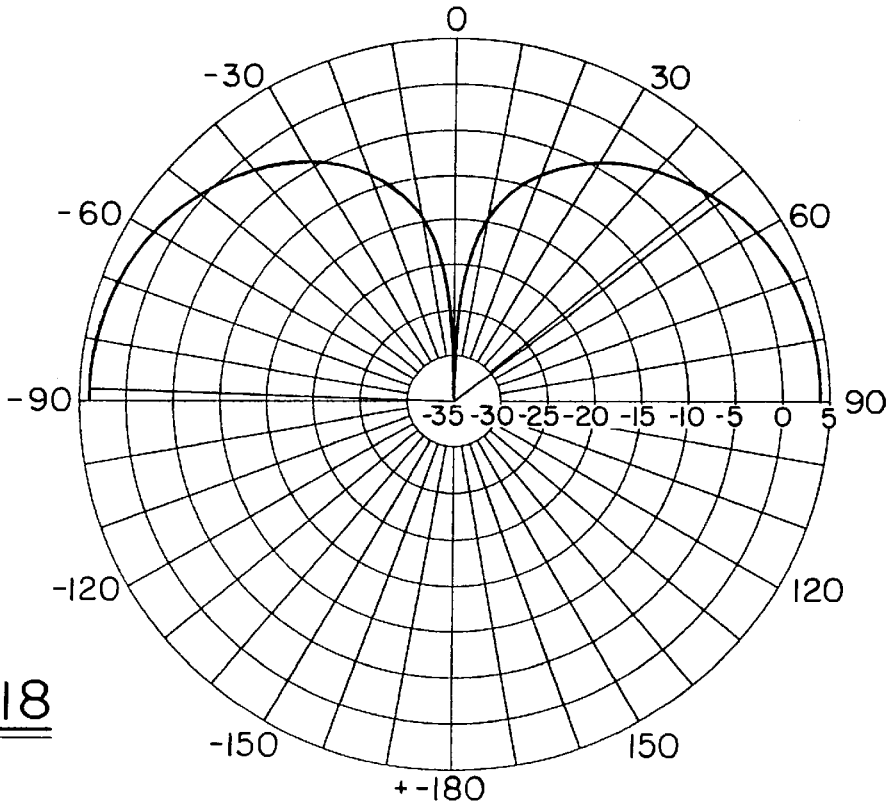
FIG. 18 is an antenna directivity pattern with the E-field broadside and perpendicular to the radiator assembly, for 174 MHz.
Figure 19:
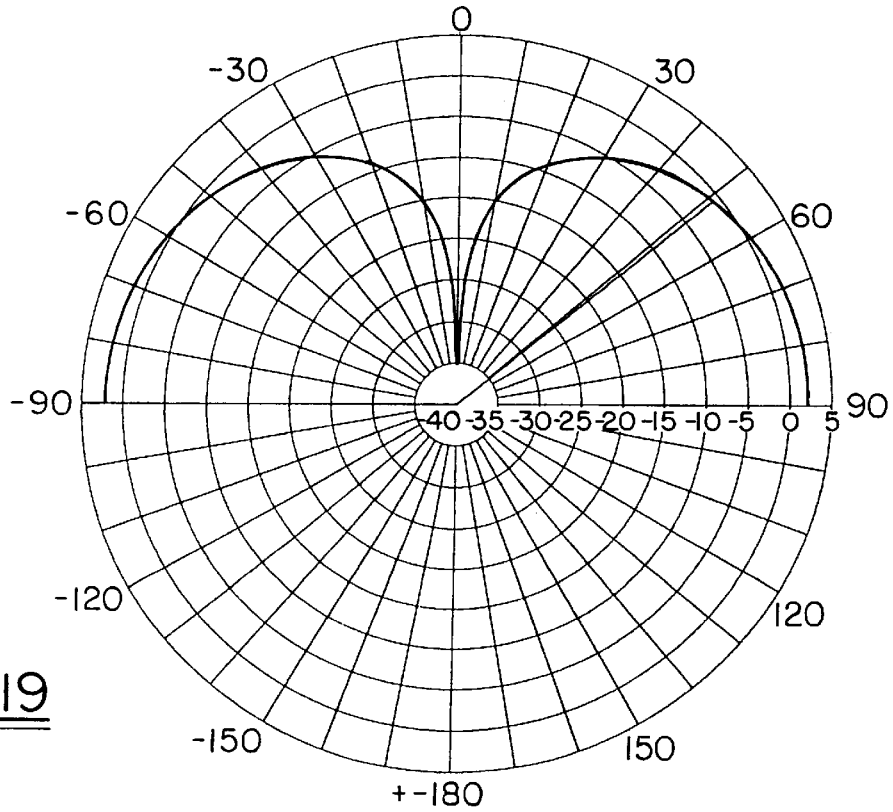
FIG. 19 shows an antenna directivity pattern of a modeled thin linear dipole for comparison to the patterns in FIGS. 16–18.

The antenna directivity pattern (the E-field that is broadside and perpendicular to the radiator access) for 136, 155, and 174 MHz is shown in FIGS. 16–18, respectively. Also shown in FIG. 19 is a modeled thin linear dipole. This evidences that when the plots of FIGS. 16–18 are compared to a free space isotropic radiator, that the maximum radiation lobe of the antenna 100 is broadside and perpendicular to the radiator assembly and further, has the largest radiation intensity as compared to either an isotropic radiator or a thin linear radiator in the broadside direction.

Based upon the foregoing, the advantages of the present invention are readily apparent. First and primarily, the antenna 100 provides an instantaneous bandwidth of 38 MHz between the frequencies of 136 to 174 MHz. Moreover, this construction provides a 2:1 or less VSWR at the connection point of the antenna 100 with the transceiver. Use of this antenna eliminates the need for special tuning circuits or the like.

Inasmuch as the present invention is subject to many variations, modifications, and changes in detail, a number of which have been expressly stated herein, it is intended that all matter discussed throughout this entire specification or shown in the accompanying drawings be interpreted as illustrative and not in a limiting sense. It should thus be evident that a device constructed according to the concepts of the present invention, and reasonable thereto, will accomplish the objects of the present invention and otherwise, substantially improve the broad band antenna art.

What is claimed is:

1. A broadband antenna operable over a predetermined broad band, comprising:

a continuous length transmission line which includes a center conductor surrounded by a dielectric material along its entire length;

a tip radiator having a series capacitance at a distal end of said continuous length transmission line;

a base radiator and a first choke having a continuous length feed point tube disposed about said transmission line, said base radiator and said first choke operatively connected to said tip radiator for changing feed point reactance values to values that provide a desired broad bandwidth to minimize the antenna's voltage standing wave ratio over frequencies in the predetermined broad band; and a second choke assembly operatively connected to said continuous length feed point tube for suppressing current below a predetermined point of the antenna to maintain the desired bandwidth and voltage standing wave ratio.

2. The antenna according to claim 1, wherein said second choke assembly is connected to said feed point tube and comprises an inverted choke spaced apart from said first choke so that one of said chokes exhibits minimal current on its outer surface.

3. The antenna according to claim 1, further comprising:

an inductance matching stub connected across the transmission line; and a capacitance matching stub connected across the transmission line.

4. The antenna according to claim 1, wherein the bandwidth is between about 136 to 174 MHz with a voltage standing wave ratio of about 2:1 or less.

5. A broadband antenna operable over a predetermined range of frequency and exhibiting a minimal voltage standing wave ratio, comprising:

a feed point tube made of conductive material receiving an insulated conductor to form an input connection, said insulated conductor extending from said feed point tube, said insulated conductor having a center conductor surrounded by a dielectric material along its entire length;

a tip radiator spaced apart from said feed point tube and disposed over and extending beyond a remaining length of said insulated conductor; and a choke assembly electrically and mechanically connected to said feed point tube to minimize any currents on said feed point tube, wherein said choke assembly comprises a choke tube electrically and mechanically connected to said feed point tube by a first washer at an end proximally adjacent said tip radiator, and an inverted choke tube electrically and mechanically connected to said feed point tube by a second washer at another end of said feed point tube, the opposite ends of said choke tube and said inverted choke tube facing one another to form a gap.

6. The antenna according to claim 5, wherein a bandwidth of the antenna is between about 136 to 174 MHz.

7. The antenna according to claim 5, wherein a voltage standing wave ratio of the antenna is less than about 2:1.

8. The antenna according to claim 5, further comprising:

an inductance matching stub connected across said insulated conductor and said feed point tube; and a capacitance matching stub connected across said insulated conductor and said feed point tube.

* * * * *